US008286945B2

(12) United States Patent
Polin, Jr. et al.

(10) Patent No.: US 8,286,945 B2
(45) Date of Patent: Oct. 16, 2012

(54) RATCHET MECHANISM

(75) Inventors: Rene Polin, Jr., Highland Heights, OH (US); Jess P. Carlson, Chagrin Falls, OH (US); David M. Pehar, Willoughby, OH (US)

(73) Assignee: Cequent Consumer Products, Solon, OH (US)

( * ) Notice: Subject to any disclaimer, the term of this patent is extended or adjusted under 35 U.S.C. 154(b) by 270 days.

(21) Appl. No.: 12/383,919

(22) Filed: Mar. 30, 2009

(65) Prior Publication Data

US 2009/0279978 A1 Nov. 12, 2009

Related U.S. Application Data

(60) Provisional application No. 61/072,141, filed on Mar. 28, 2008.

(51) Int. Cl.
*B21F 9/00* (2006.01)

(52) U.S. Cl. ..... 254/239; 254/223; 24/698.1

(58) Field of Classification Search ..... 254/217, 254/218, 223, 225, 239; 24/67 CD, 68 B, 24/909, 265 H, 199, 265 AL, 318, 321, 698.1, 24/698.3

See application file for complete search history.

(56) References Cited

U.S. PATENT DOCUMENTS

| | | | | | |
|---|---|---|---|---|---|
| 384,512 | A | * | 6/1888 | Dillon | 24/165 |
| 604,302 | A | | 5/1898 | Clark | |
| 1,606,221 | A | | 11/1926 | Hergesheimer | |
| 2,526,216 | A | | 10/1950 | Gartner | |
| 2,597,351 | A | * | 5/1952 | Mackenzie | 24/68 B |
| 3,718,315 | A | * | 2/1973 | Huber | 24/68 B |
| 3,826,473 | A | | 7/1974 | Huber | |
| 3,965,539 | A | | 6/1976 | Golden | |
| 4,155,537 | A | | 5/1979 | Bronson et al. | |
| 4,268,012 | A | * | 5/1981 | Ruehle et al. | 254/223 |
| 4,913,608 | A | | 4/1990 | Royball | |
| 5,282,296 | A | * | 2/1994 | Huang | 24/68 CD |
| 5,779,001 | A | | 7/1998 | Skyba | |
| 6,195,848 | B1 | | 3/2001 | Jackson et al. | |
| 6,230,370 | B1 | | 5/2001 | Nelsen | |
| 6,499,723 | B1 | | 12/2002 | McNarry et al. | |
| 6,524,041 | B1 | | 2/2003 | Voiculescu | |
| 6,682,053 | B1 | * | 1/2004 | Chou | 254/218 |
| 6,799,751 | B1 | | 10/2004 | Anderson | |
| 7,360,753 | B1 | | 4/2008 | Lin | |
| 7,877,846 | B1 | * | 2/2011 | Chen et al. | 24/68 CD |
| 7,909,306 | B2 | * | 3/2011 | Adcock | 254/218 |
| 2008/0232922 | A1 | | 9/2008 | Chang | |
| 2009/0047091 | A1 | | 2/2009 | Huck | |

* cited by examiner

*Primary Examiner* — Emmanuel M Marcelo
(74) *Attorney, Agent, or Firm* — McDonald Hopkins LLC

(57) ABSTRACT

A securing mechanism for securing cargo that may include a body, a ratchet, a lever and a release mechanism. The body may be capable of receiving a strap therethrough, wherein the strap may includes opposing ends. The ratchet may include a pair of opposing arms connected to the body and a spool rotatably connected to the arms. The spool may include a slot to receive the strap into a z-fold configuration. The lever may be rotatably attached to the arms and reciprocated between an open position and a closed position, wherein the lever may include at least one pawl to engage the ratchet wheels and may rotate the spool when the lever is reciprocated. The release mechanism may be capable of selectively disengaging the pawl from the ratchet wheel. The securing mechanism may be selectively positionable along the strap when the strap is bi-directionally gathered onto the spool.

24 Claims, 12 Drawing Sheets

RATCHET MECHANISM

CROSS-REFERENCE TO RELATED APPLICATIONS

This application claims benefit from U.S. Provisional Patent Application No. 61/072,141, entitled "Ratchet Mechanism," filed on Mar. 28, 2008, which is hereby incorporated in its entirety by reference.

FIELD OF THE INVENTION

The present invention relates generally to a securing mechanism, and more specifically, to a bi-directional ratchet mechanism that may be positioned anywhere along a strap.

BACKGROUND

Ratchet and strap tightening devices are well know for removing slack in straps and securing the straps in a tensioned condition to secure loads or cargo for hauling or transport. In the prior art, belt type mechanisms or lengths of material are commonly used to retain a load, cargo or structure in place. For example, belts are frequently used to retain stacked articles in place on a pallet are commonly employed on vehicles and trailers to secure cargo or items.

Typical load or cargo tighteners often include a ratchet mechanism having two straps. The first (and generally short) strap is firmly secured at one end to the mechanism and is connected at the other end to an anchor point or mounting structure on a vehicle or trailer. The second strap is also capable of being attached at one end to a mounting structure on the vehicle or trailer. The second strap is typically connected to a rotatable shaft on the ratchet mechanism so that the connecting member on the second strap may be drawn out and connected to a mounted structure. As the mechanism is ratcheted and the shaft rotates, the second strap is wound about the rotatable shaft so that the second strap tightens down over the cargo in a tensioned condition to secure the load.

Such cargo tighteners suffer from a variety of deficiencies. Generally, tighteners may have a set geometry and cannot be selectively positioned along the length of either strap, which would facilitate easier operation of the device. Other types of tighteners may permanently incorporate the ratchet mechanism directly on the belt itself. Therefore, the tightener cannot be positioned, for example, to avoid contact with the cargo or vehicle.

In addition, cargo tighteners often require two separate straps for mounted to the ratchet mechanism, increasing the cost of the device. Further, such tighteners require a significant amount of time and effort to manipulate the ratchet mechanism to secure the cargo to the vehicle.

Therefore, there is a need in the art for an improved ratchet mechanism that may overcome these and other drawbacks. The ratchet mechanism may also be selectively positionable along the length of a strap as well as take up any slack in the strap bi-directionally, thereby reducing the amount of time needed to secure the load or cargo.

DESCRIPTION OF THE DRAWINGS

Objects and advantages together with the operation of the embodiments may be better understood by reference to the following detailed description taken in connection with the following illustrations, wherein.

SUMMARY OF THE INVENTION

A securing mechanism for securing cargo. The securing mechanism may include a body, a ratchet, a lever and a release mechanism. The body may be capable of receiving a strap therethrough, wherein the strap may includes opposing ends. The ratchet may include a pair of opposing arms that may be connected to the body. The ratchet may also include a spool rotatably connected to the opposing arms, where the spool may include a slot to receive the strap. The ratchet may also include a pair of ratchet wheels that may be connected to opposing ends of the spool, where the spool may gathers the strap into a z-fold configuration via the slot. The lever may be rotatably attached to the arms and reciprocated between an open position and a closed position, wherein the lever may include at least one pawl to engage the ratchet wheels and may rotate the spool when the lever is reciprocated. The release mechanism may be capable of selectively disengaging the pawl from the ratchet wheel. The securing mechanism may be selectively positionable along the strap when the strap is bi-directionally gathered onto the spool.

DETAILED DESCRIPTION

FIGS. 1-18 illustrate embodiments of securing mechanism 10 ("mechanism 10"). The mechanism 10 may combine the function and benefits of a typical ratchet mechanism into an improved securing mechanism that only utilizes one strap 35, thereby eliminating the need for extra components, which results in cost savings while also speeding up the time it takes to secure a load or cargo.

Figure 2:
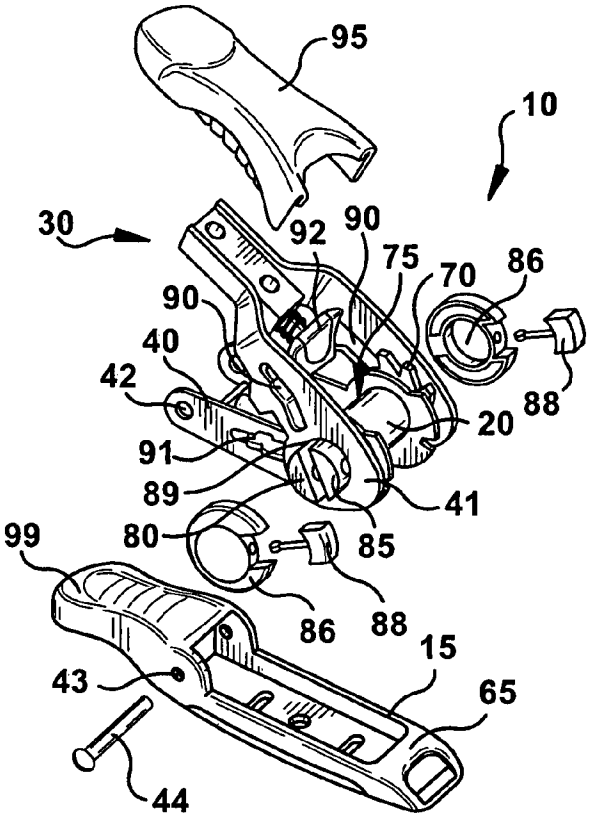
FIG. 2 illustrates a partial exploded view of the securing mechanism of FIG. 1.
Figure 1:
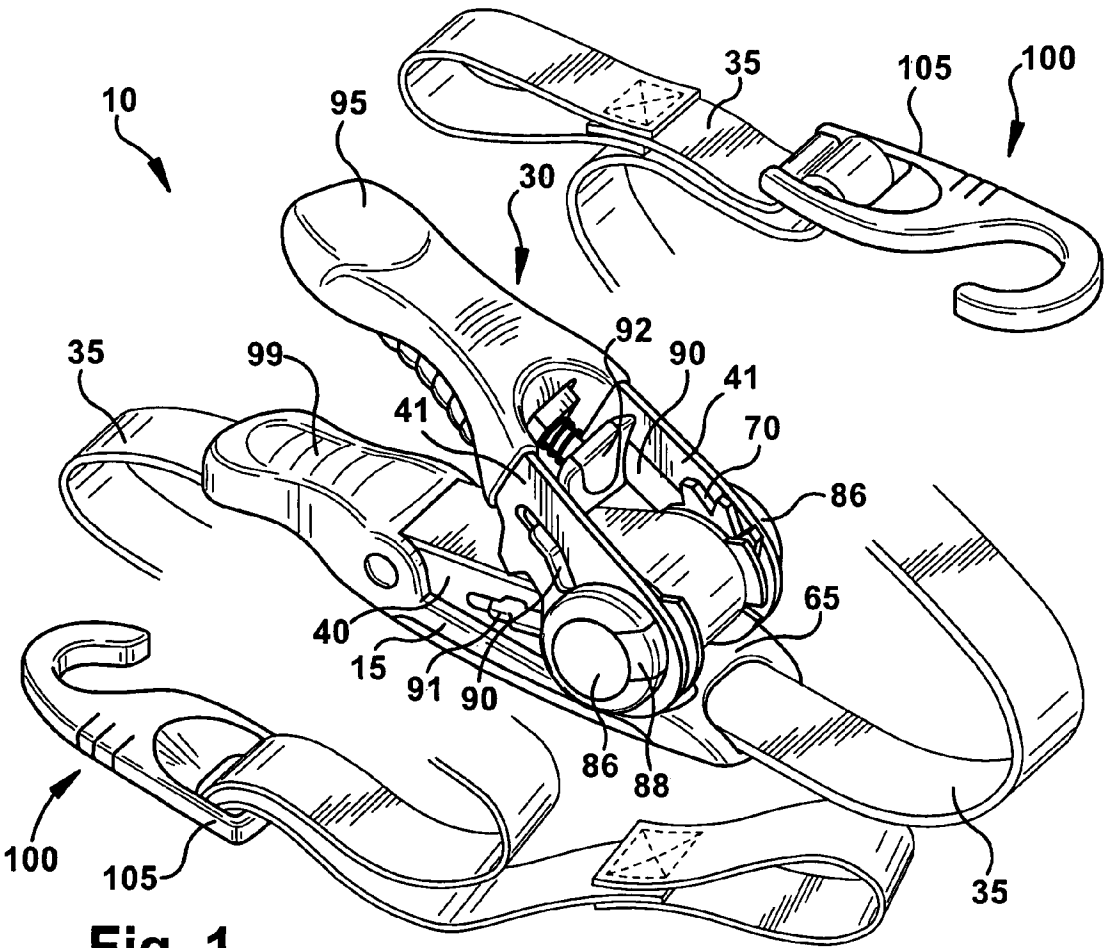
FIG. 1 illustrates a perspective view of an embodiment of a securing mechanism.

As shown in FIGS. 1 and 2, the mechanism 10 may include a body 15, a spool hub 20 ("spool 20"), and a lever 30. The mechanism 10 may be selectively positionable along a length of a strap 35. In addition, the mechanism 10 may be capable of bi-directionally gathering the strap 35 about the spool 20 to secure an item or cargo. The body 15 may also include a cap or handle 99 and a strap guide 65. The cap or handle 99 may aid in the securing or ratcheting process. The strap guide 65 may aid in guiding the strap 35 into the ratchet mechanism and onto the spool 20.

As shown in FIG. 1, the body 15 may be configured to be rotatably attached to the spool 20. The spool 20 may include at least one arm 40. As shown in FIGS. 1 and 2, the spool 20 may be secured to the body 15 with one or more arms 40. The pair of arms 40 may be located approximately parallel to one another. Each arm 40 may include at least one aperture 42 for attachment to the body 15. The apertures 42 in the arms 40 may be of any appropriate shape or size. The body 15 may also include at least one aperture 43 for attachment to the arms 40. The apertures 43 in the body 15 may be of any appropriate shape or size. The apertures 43 in the body 15 may be of a correspondingly similar shape or size as the apertures 42 in the arms 40. The body 15 and the arms 40 may be attached via their apertures 42, 43 by a fastener 44, such as a bolt, screw, or the like, for example.

Figure 4:
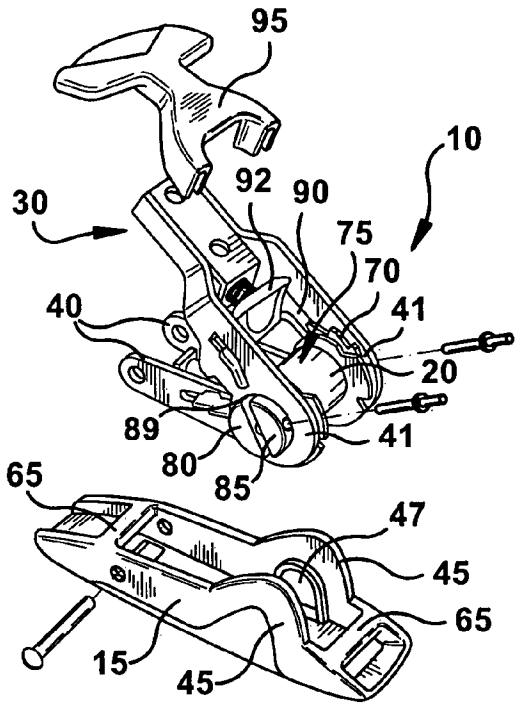
FIG. 4 illustrates a partial exploded view of the securing mechanism of FIG. 3.
Figure 3:
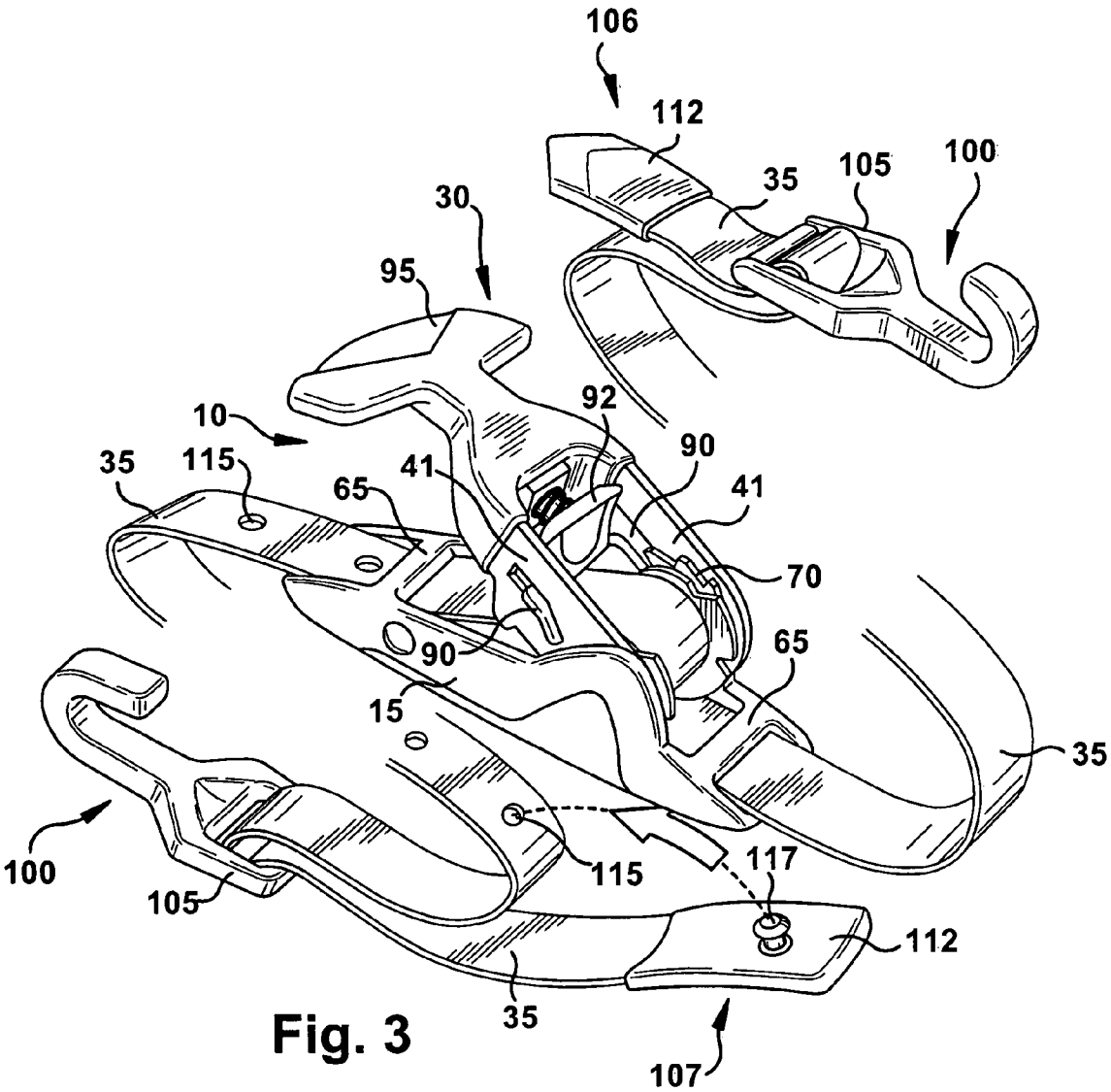
FIG. 3 illustrates a perspective view of an alternative embodiment of a securing mechanism.

In an alternative embodiment, as shown in FIGS. 3 and 4, the body 15 may also include at least one wall 45. The walls 45 may be used to secure the spool 20 to the body 15. Each wall 45 may include a lip 47. The lip 47 may be of any appropriate shape, such as a shape to retain the spool 20 therein. It is to be understood, however, that one of ordinary skill in the art will appreciate that any variety of appropriate configurations may be used for rotatably securing the spool 20 to the body 15 and should not be limited to the examples provided herein.

As shown in FIGS. 5, 7-10, 13 and 15, the body 15 may include one or more recesses or apertures 50. The recesses or apertures 50 may be located at any appropriate or desired position on the body 15, such as the corners, ends, sides, and the like, for example. The recesses or apertures 50 may be used for any appropriate purpose, such as attaching additional devices 55 such as rope, bungee connectors, tarps, and the like, for example. These types of devices 55 may be used to further restrain the item to be secured or to connect any additional type of item that may be needed, for example.

Figure 11:
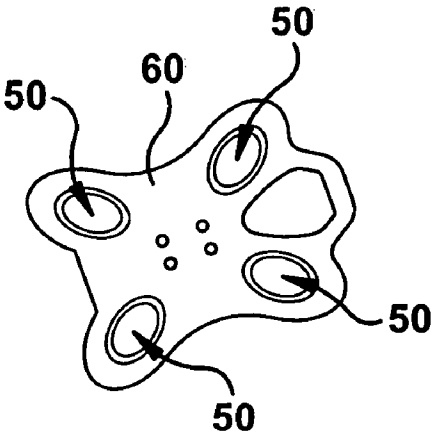
FIG. 11 illustrates a top view of the plate of the securing mechanism of FIG. 10.
Figure 10:
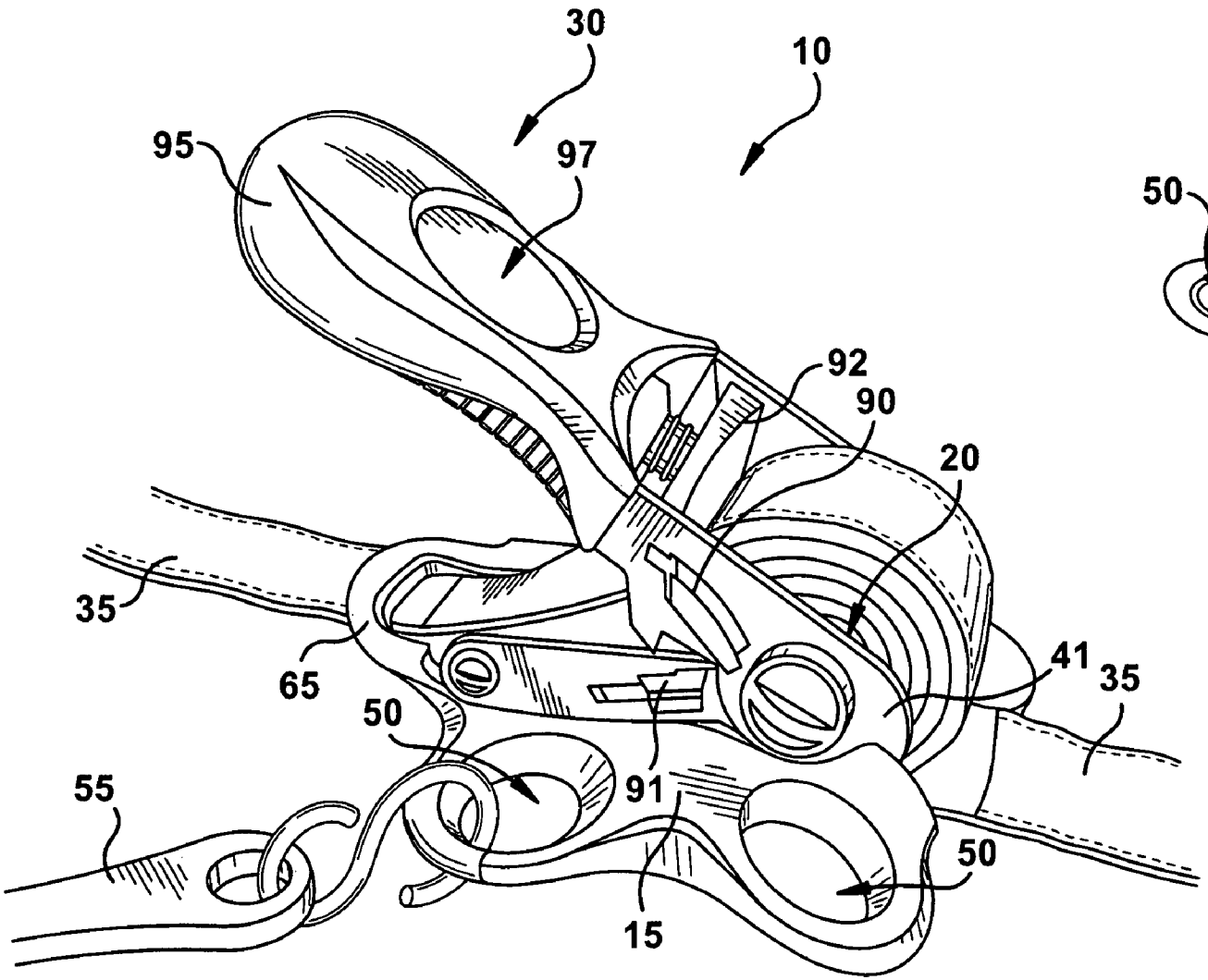
FIG. 10 illustrates a perspective view of an alternative embodiment of a securing mechanism.

As an alternative, as illustrated in FIGS. 10 and 11, the body 15 may also be provided with a non-abrasive and soft plate 60. The soft plate 60 may be comprised of any appropriate material, such as a polymer, plastic, rubber material, or the like, for example. The plate 60 may be attached to the existing body 15 of the mechanism 10. The plate 60 may be attached by any appropriate means, such as by snapping onto the body 15 or being attached by adhesives or the like, for example.

As a further alternative, the body 15 may also be comprised of an overmolded base that may protect any cargo from damage by the securing mechanism 10. As another alternative, the body 15 may include a non-abrasive coating or layer. The layer may be of a variety of appropriate non-abrasive materials, including, but not limited to cloth, plastics, rubber, and the like. Although shown as covering only a portion of the body 15, such as the underside of the body 15, it is to be understood that any portion or the entire mechanism 10 may be covered with such a layer.

As mentioned above, and shown in FIGS. 1-10, 13 and 15, the body 15 may also contain one or more strap guides 65. The strap guide 65 may be positioned at any appropriate location on the body 15. The strap guides 65 may facilitate the feeding and guiding of the strap 35 to and from the spool 20 and into the ratchet mechanism. It is to be understood that the strap guide 65 may be a separate part, or formed integrally with, or connected to, the body 15. If the strap guide 65 is a separate part, the guide 65 may be attached to the body 15 by any appropriate means, such as by fasteners, adhesives, or the like. While the strap guides 65 may be shown on the body 15 it is to be understood that the guides 65 may be located on any appropriate part of the mechanism.

As best shown in FIGS. 2 and 4, the spool 20 may be of any appropriate shape or size, so that the spool 20 may gather the strap 35 around its outer surface as it is rotated. For example, the spool 20 may be of a generally cylindrical shape. The spool 20 may also be provided with an aperture or slot 75. The aperture or slot 75 may be of any appropriate size or shape, such as being capable of allowing the strap 35 to be inserted through the spool 20, as shown in FIG. 10A. In a non-limiting example, as shown in FIGS. 2 and 4, the spool 20 may include two halves or parts 80, 85. As shown in FIG. 2, the two spool parts 80, 85 may be secured with an end cap 86 and fastening element 88. As shown in FIG. 4, the two spool parts 80, 85 may be secured with a fastener 87, such as a bolt, screw or the like, to form the slot 75.

As shown in FIGS. 2 and 4, the lever 30 may be provided with on or more apertures 89 for receiving the spool 20. The apertures 89 may be located at any appropriate position on the lever 30, such as on either leg 41 of each said of the lever 30. The lever 30 may include at least one leg 41. The pair of legs 41 may be located approximately parallel to one another. The lever 30 may be secured to the spool 20 by any appropriate means, such as with fasteners (not shown), adhesives, being reciprocally secured to the spool 20 with end caps 86 and fastening elements 88 (FIGS. 1 and 2) or with walls 45 (FIGS. 3 and 4), or the like. As shown in FIGS. 1 and 2, the lever 30 may be secured to the spool 20 via the apertures 89.

The mechanism 10 may also include one or more ratchet wheels 70. The ratchet wheels 70 may be located at any appropriate location on the securing mechanism 10, such as on the spool 20, for example. The ratchet wheels 70 may be connected to the spool 20 to facilitate rotation of the spool 20 during a ratcheting operation, as discussed in greater detail below. For example, the spool 20 may include one ratchet wheel 70 located on either end of the spool 20, whereby the ratchet wheels 70 may be located between the arms 40 of the body 15 and the arms 41 of the lever 30, as illustrated in FIGS. 1-4

The securing mechanism 10 may also include one or more fingers or pawls 90. The first finger or pawl 90 may be connected to the securing mechanism 10 by any appropriate means. For example, the first finger or pawl 90 may be slidably connected to the lever 30 and spring biased to engage the ratchet wheels 70. In addition, a second finger or pawl 91 may also be provided along arms 40, as shown in FIGS. 1 and 2. The second finger or pawl 91 may also be slidably connected to the arms 40 and spring biased to engage the ratchet wheels 70.

Figure 5:
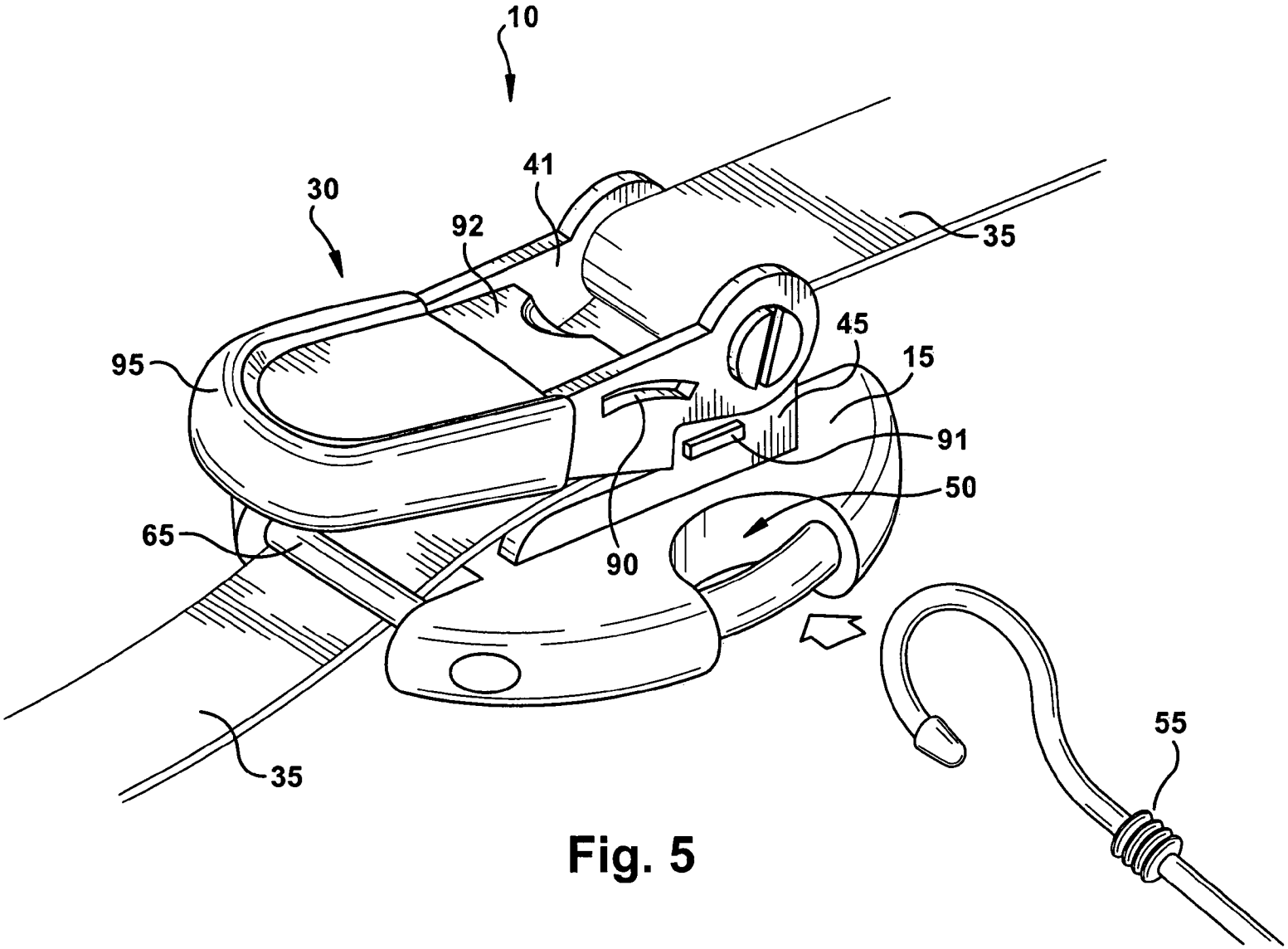
FIG. 5 illustrates a perspective view of an alternative embodiment of a securing mechanism.
Figures 6, 7:
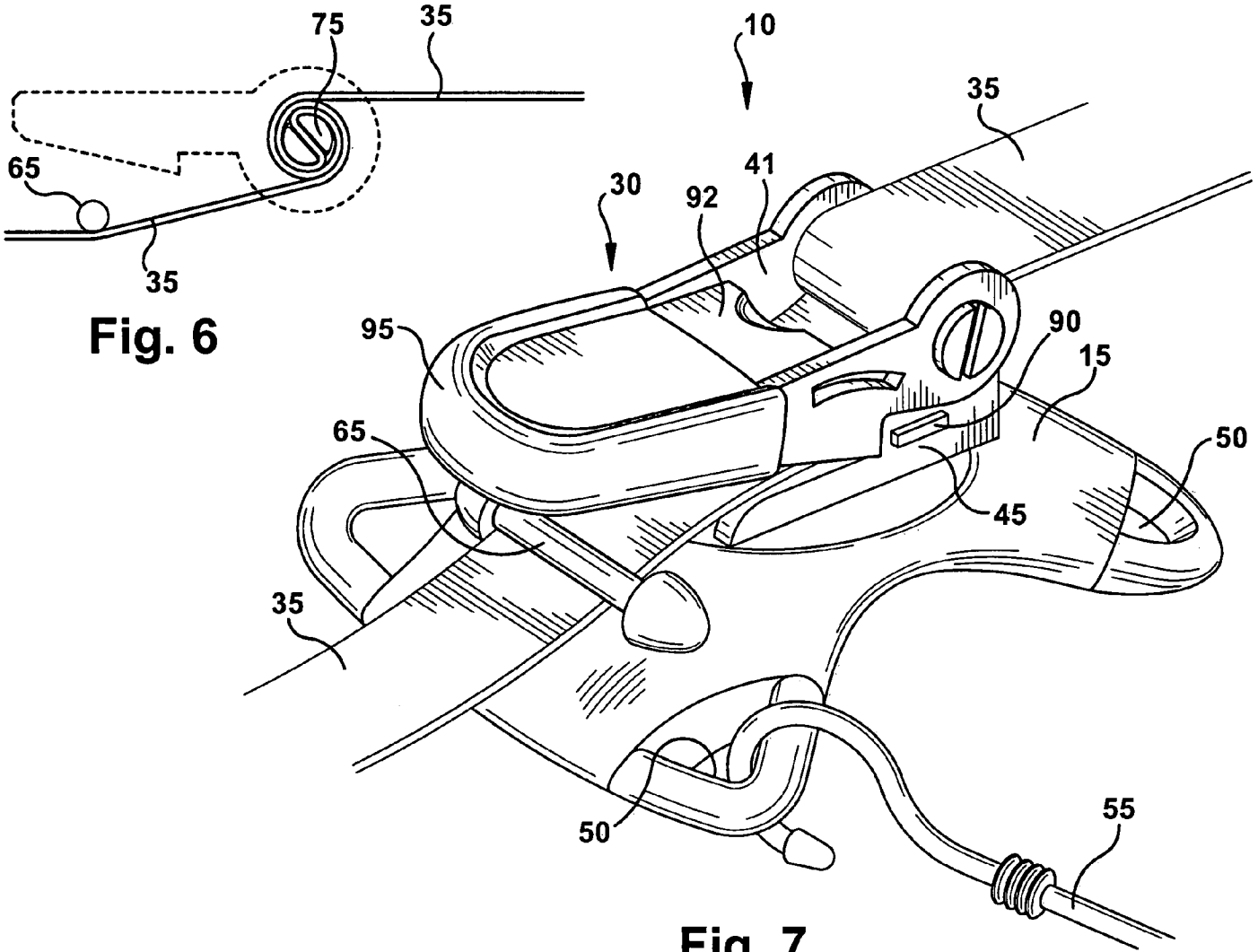
FIG. 6 illustrates a partial side view of an embodiment of a securing mechanism.
FIG. 7 illustrates a perspective view of an alternative embodiment of a securing mechanism.

As illustrated in FIGS. 1-5, 7-10, 12A, 12B and 13, the mechanism 10 may further include a release mechanism or button 92. The button 92 may be of any appropriate shape or size, as shown in FIGS. 1 and 5. The release mechanism or button 92 may be positioned at any appropriate location on the mechanism 10, such as on the lever 30, for example. The release mechanism or button 92 may be provided for selectively engaging and disengaging the fingers 90 with the ratchet wheels 70. For example and illustrative purposes only, when the user desires to unload or unsecure the cargo or load, the user may push on the release mechanism or button 92 to do so. The release mechanism 92 may be configured to work with lever 30 via any appropriate means, such as by a spring.

Figure 12A:
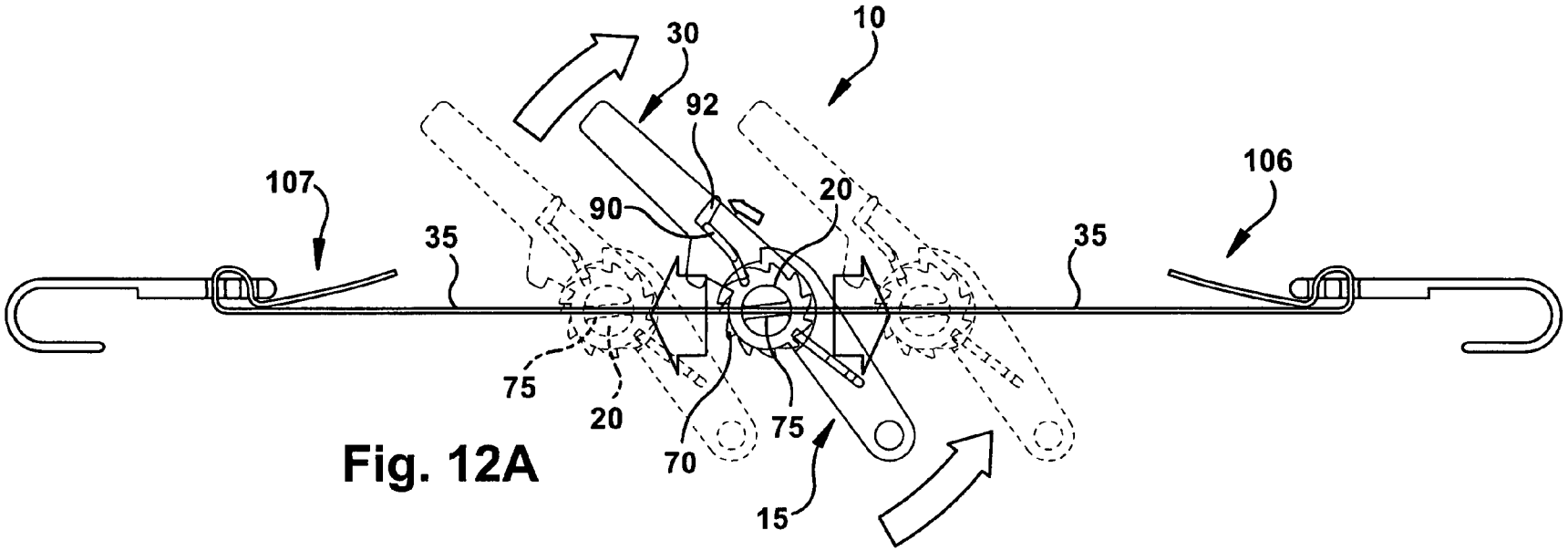
FIG. 12A illustrates a side view of an embodiment of the securing mechanism in a moveable open position.
Figure 12B:
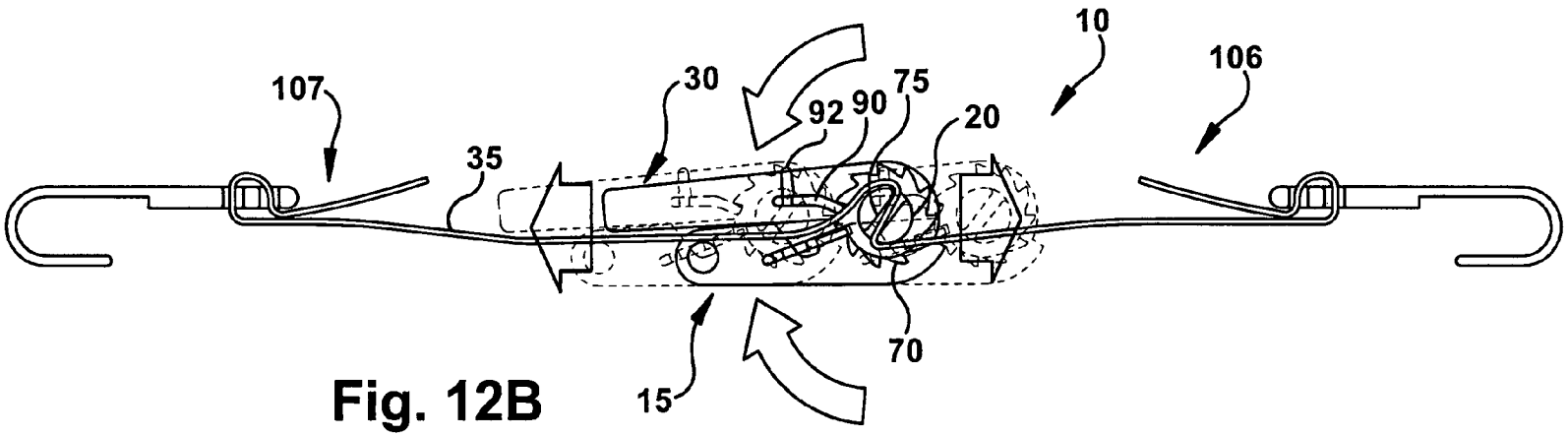
FIG. 12B illustrates a side view of an embodiment of the securing mechanism in a closed position.
Figure 12C:
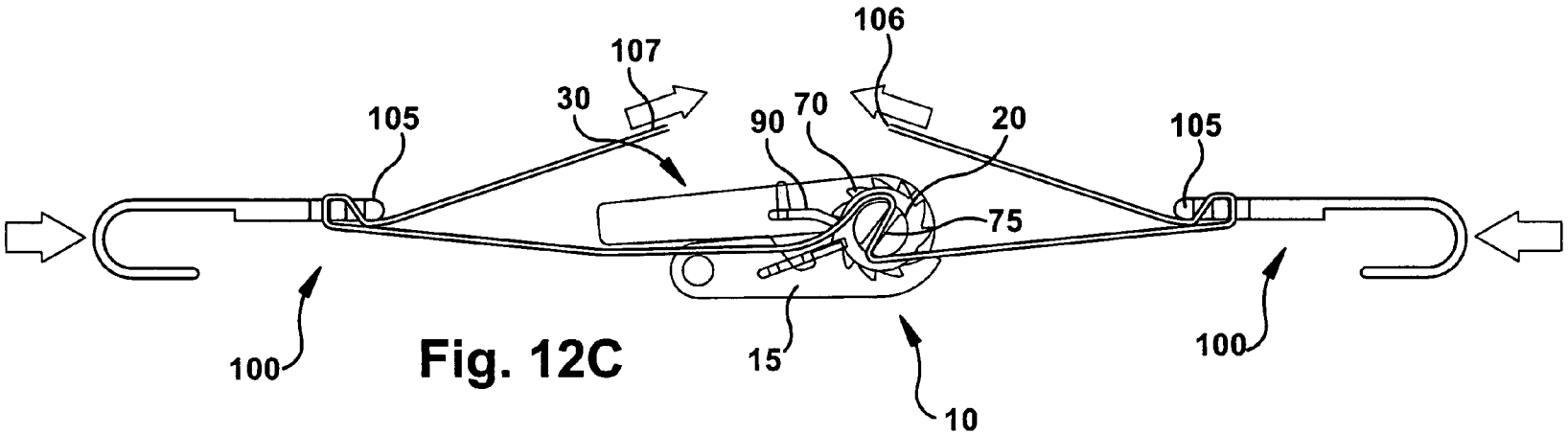
FIG. 12C illustrates a side view of an embodiment of the securing mechanism in the closed position with the quick-tightening features in use.

Reciprocal motion of the lever 30 with the body 15 while the fingers 90 are engaged with the ratchet wheels 70 causes the spool 20 to rotate. Unlike prior ratchets, the slot 75 may allow the securing mechanism 10 to be selectively positioned along the strap 35, as shown in FIG. 12A. Further, when the securing mechanism 10 is folded to a closed position and the finger 90 is engaged with the ratchet wheel 70, as shown in FIGS. 12B and 12C, the spool 20 may gather the strap 35 into a Z-fold configuration. The Z-fold configuration may prevent the mechanism 10 from slipping along the strap 35, while still allowing a user to further position the mechanism 10 along the length of the strap 35 with minimal effort.

Figure 12D:
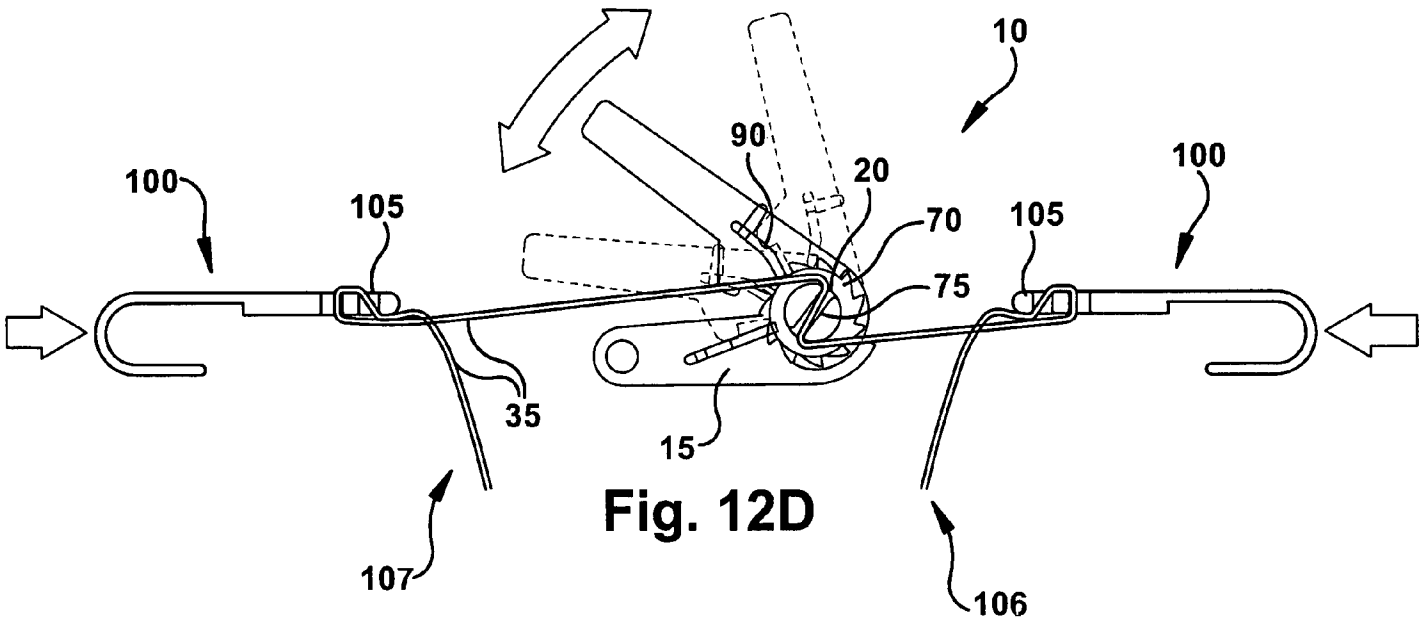
FIG. 12D illustrates a side view of an embodiment of the securing mechanism in use bi-directionally gathering the strap.

As shown in FIG. 12D, when the lever 30 is reciprocated, the strap 35 may be gathered onto the spool 20. The strap 35 may be gathered onto the spool 20 in any appropriate manner, but the strap 35 may preferably be gathered onto the spool 20 bi-directionally. In other words, the strap 35 may be gathered onto the spool 20 from both directions at the same time, thereby increasing the speed by which the cargo or load is secured. Since the strap 35 may be gathered bi-directionally and may also be selectively positioned anywhere along the strap 35, only one strap 35 may be required to secure the cargo instead of two or more. Accordingly, the strap 35 may be gathered around and released from the spool 20 approximately twice as fast as prior art ratchets.

As shown in FIGS. 1-5, 7-10, 13 and 15, the mechanism 10 may further include a handle 95. The handle 95 may be positioned at any appropriate location on the mechanism, such as on the lever 30. The handle 95 may also be of any appropriate shape or size, as illustrated in FIGS. 1, 3, 5, 8, 10, 13 and 15. It is to be understood that the handle 95 may be ergonomically shaped to aid in ease of use and be more comfortable for the user to operate the mechanism 10. The handle 95 may also be integrally formed with the lever 30 or may be a separate part from the lever 30. If the handle 95 is a separate part from the lever 30, the handle 95 may be secured to the lever 30 by any appropriate means, such as with fasteners, adhesives, and the like, for example.

Figure 8:
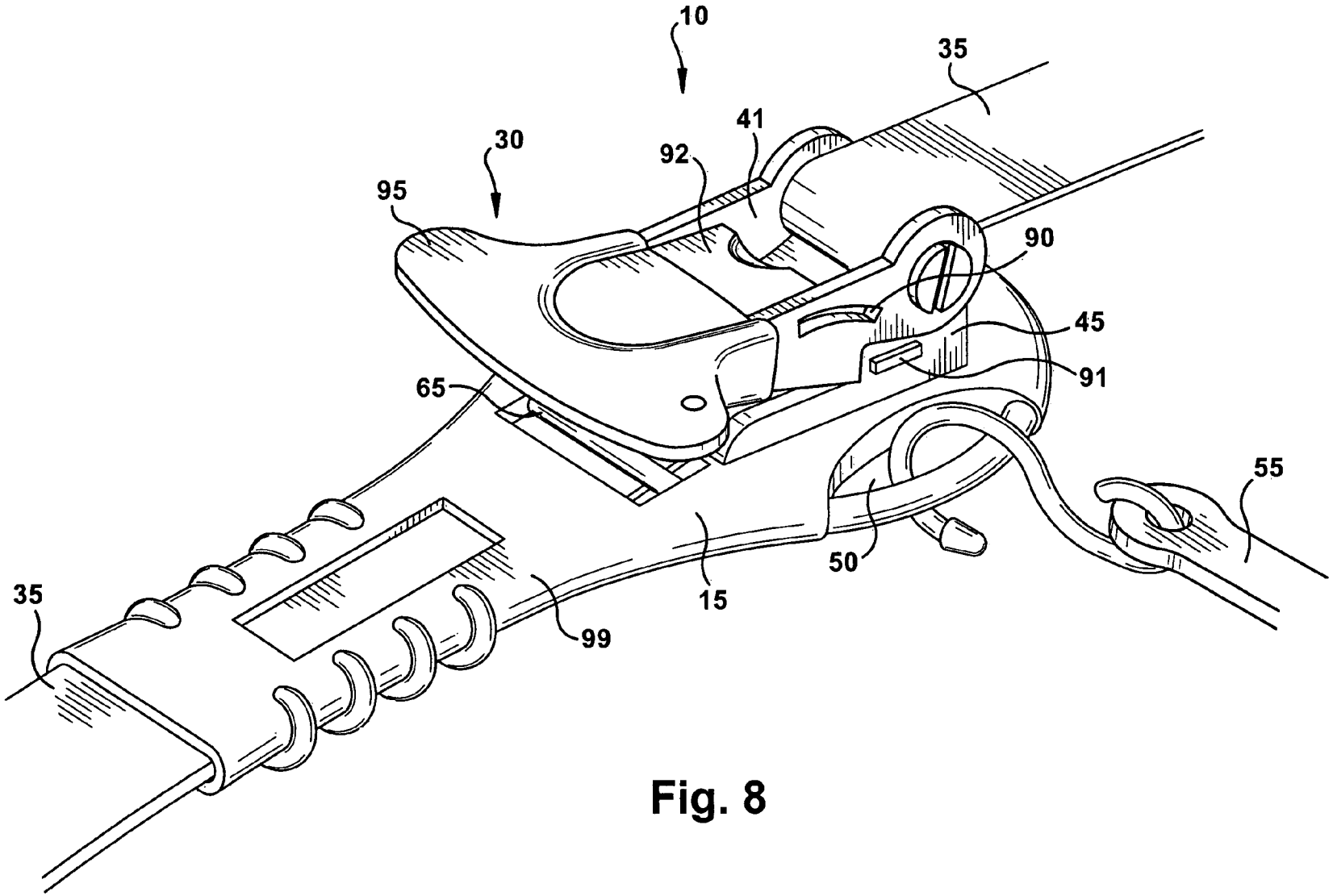
FIG. 8 illustrates a perspective view of an alternative embodiment of a securing mechanism.
Figure 9:
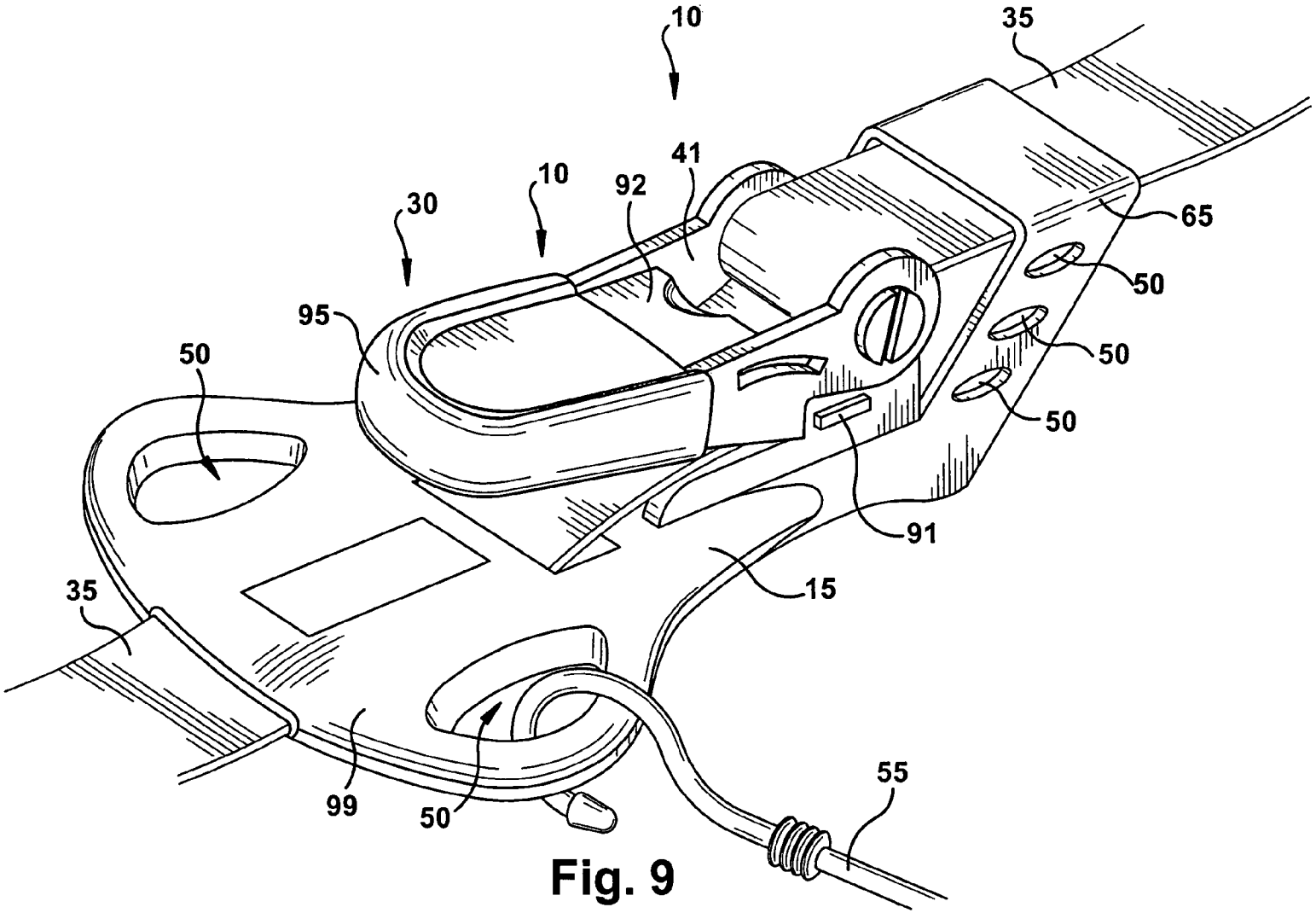
FIG. 9 illustrates a perspective view of an alternative embodiment of a securing mechanism.
Figure 13:
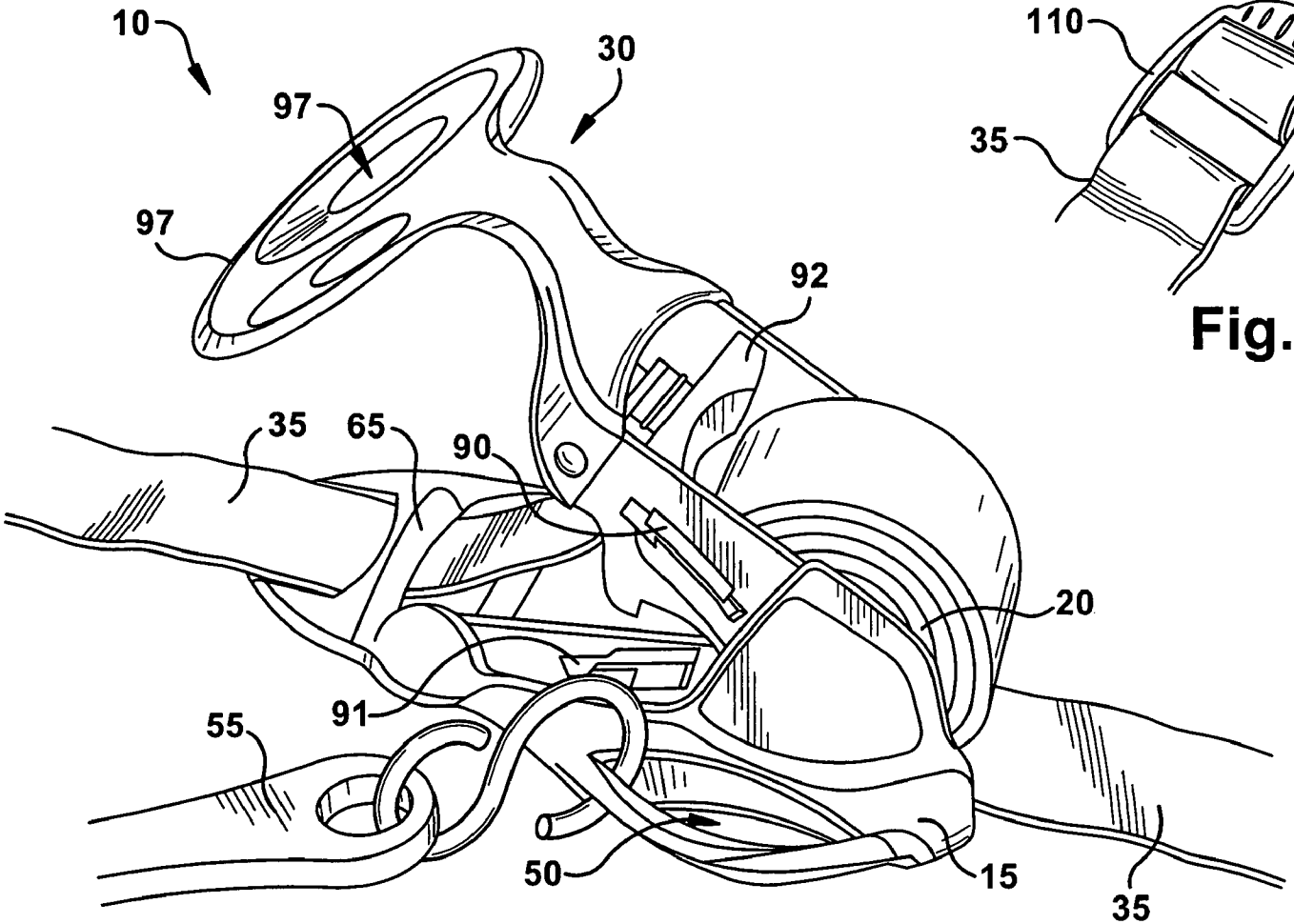
FIG. 13 illustrates a perspective view of an alternative embodiment of a securing mechanism.
Figure 15:
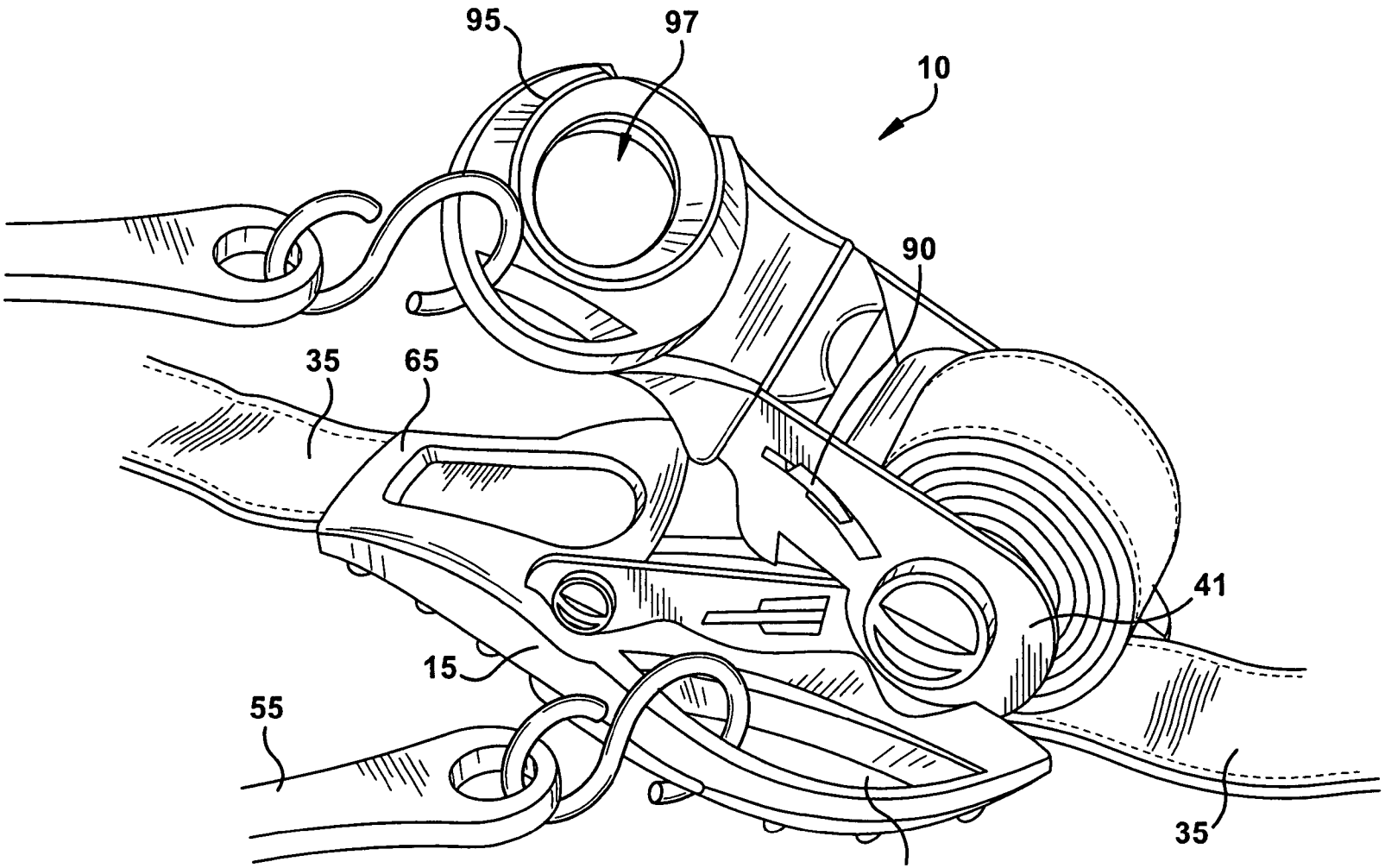
FIG. 15 illustrates a perspective view of an alternative embodiment of a securing mechanism.

As shown in FIGS. 10, 13 and 15, the handle 95 may also be provided with a recess or aperture 97. The recess or aperture 97 may be utilized to facilitate connection to a device 55. As stated above, the mechanism 10 may also include a cap or second handle 99. The cap or second handle 99 may be provided to facilitate the ratcheting process. As best shown in FIGS. 1 and 8, the second handle 99 may be integrally formed with the body 15 or may be a separate part from the body 15. If the handle 99 is a separate part from the body 15, the second handle 99 may be secured to the lever 30 by any appropriate means, such as with fasteners, adhesives, and the like, for example. The second handle 99 may also be configured to operate as a strap guide. As shown in FIG. 8, the second handle 99 may extend a distance down and around the strap 35.

The strap 35 of the securing mechanism 10 may also include a first strap end 106 and a second strap end 107. The strap ends 106, 107 may be located on either end of the strap 35. As shown in FIGS. 1, 3 and 12A-12D, the securing mechanism 10 may also include one or more securing members 100. The securing members 100 may be provided for securing the strap ends 106, 107 to any appropriate type of object, such as a vehicle, trailer, or the like, for example. In an illustrative example, the securing member 100 may be shaped like a hook, as shown in FIGS. 1, 3 and 12A-12D. As another example, the securing members 100 may be interchangeable so that, for example, a variety of different and appropriate configurations may be used, such as a flat hook, double hook, or the like.

The securing mechanism 10 may also include a quick-tightening feature 105. The quick-tightening feature 105 may be located on the securing member 100. The quick-tightening feature 105 may permit the strap 35, such as the strap ends 106, 107, to be slidably secured to the securing member 100. The quick-tightening feature 105 may be of any appropriate type of apparatus or device.

As shown in FIGS. 1 and 3, the quick-tightening feature 105 may be a buckle. Such a quick-tightening feature 105 may allow any slack in the strap 35 to be cinched tightly at any appropriate or desired time, such as prior to ratcheting and gathering the strap 35 onto the spool 20. This ability to quickly tighten any excessive slack in the strap 35, such as prior to utilizing the ratchet mechanism, may reduce the overall time and effort required to reciprocate the lever 30 during the ratcheting process. The quick-tightening feature 105 may also prevent too much of the strap 35 from being gathered onto the spool 20, which may hinder the ability of the spool 20 to effectively gather the strap 35.

Figure 14:
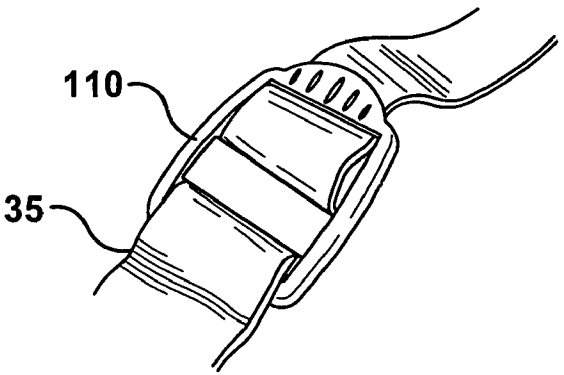
FIG. 14 illustrates a strap with a buckle.

The strap 35 may be made from any variety of appropriate materials, such as natural or synthetic materials for example. In a non-limiting example, the strap 35 may be shaped or fabricated from a material that will not fold and seize the spool 20, such as of a generally rectangular shape, as shown in the FIGS. In another example, the strap 35 may be a rope. In addition, as another alternative, the mechanism may include one or more buckles 110, as shown in FIG. 14. The buckles 110 may be provided at any appropriate or desired location along the strap 35. The buckles 110 may provide for additional adjustability.

In an alternative embodiment, the strap ends 106, 107 of the strap 35 may be reinforced by any appropriate means to prevent fraying, tearing, dragging, or the like. For example, as shown in FIG. 3, the securing mechanism 10 may include a cover 112. The cover 112 may be secured over the strap ends 106, 107. The cover 112 may be made from any variety of appropriate materials, including, but not limited to, metal, plastic, composites, and the like. In an illustrative example, the cover 112 may be of a Tyvek® material that may be heat-sealed to the strap ends 106, 107. As another alternative, the strap 35 may further include one or more recesses or apertures 115 and the cover 112 may include one or more protrusions 117. For example, the protrusion 117 may be inserted and fit into the apertures 116 to prevent the ends 106, 107 from dangling loosely.

As another alternative, a cover (not shown) may be provided for the mechanism 10. A locking mechanism (not shown) may also be provided for the mechanism 10. The locking mechanism may protect the mechanism 10 from manipulation from unauthorized users or from any accidental manipulation due to the elements or while driving. The locking mechanism may include any appropriate type of locking, such as a traditional lock and key, a combination lock, or the like, for example.

It is also to be understood that a variety of other types of appropriate configurations or drives may be utilized with the spool 20. For example, instead of a ratchet configuration, the spool 20 may be rotated with a screw-type drive (not shown)

to gather the strap 35 about the spool 20. Further, a tension indicator (not shown) may be provided for load-specific applications to indicate when a desired strap 35 tension is reached. In addition, a locking indicator (not shown) may be provided to indicate that the pawls or fingers 90, 91 are in a locked engagement with the ratchet wheels 70.

Figure 16:
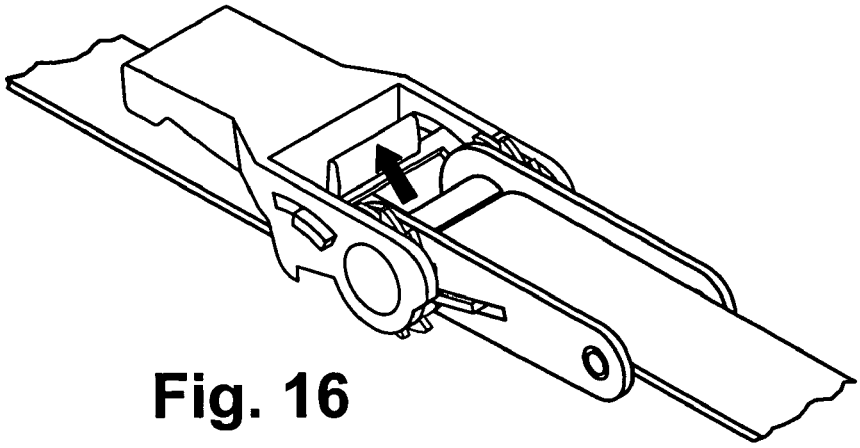
FIG. 16 illustrates a perspective view of an embodiment of a securing mechanism in use.

Turning to the mechanism 10, an example of a method of using the mechanism 10 as illustrated in FIGS. 1 through 18 is set forth below. For illustrative purposes only, as shown in FIG. 12A, the strap 35 may be inserted through the spool 20 via the slot 75. As shown in FIGS. 12A and 16, the button or release mechanism 92 may be pressed to unlock the spool 20. As the spool 20 is unlocked, the fingers 90, 91 may be released from the ratchet wheels 70, thereby permitting the securing mechanism 10 to be opened at an approximately 180 degree angle.

Figure 17:
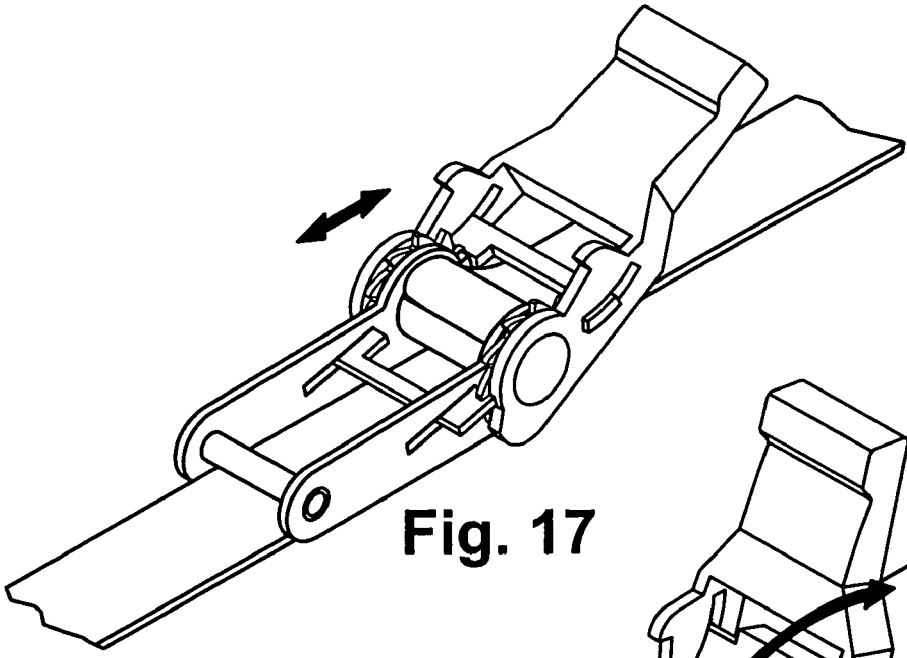
FIG. 17 illustrates a perspective view of an embodiment of a securing mechanism in use.

As shown in FIGS. 12A and 17, the mechanism 10 may be freely positioned anywhere along the length of the strap 35. This allows, for example, the mechanism 10 to be positioned in a more comfortable ratcheting position, or away from cargo or surfaces that the user does not want to contact with the mechanism 10. Moving the securing mechanism 10 away from the cargo may prevent the cargo from being scratched by the mechanism 10.

FIG. 12B illustrates the mechanism 10 folded into a closed position. When the mechanism 10 is folded closed, the mechanism 10 is prepared to either tighten via a standard ratcheting motion, as shown in FIG. 12D, or by using the quick-tightening features 105, as shown in FIG. 12C. In addition, once in the closed position the spool 20 may gather the strap 35 into a substantially Z-fold configuration. The Z-fold configuration may prevent the mechanism 10 from slipping along the strap 35, while still allowing the user to adjust or position the mechanism 10 at any appropriate position along the length of the strap 35 while in the closed position.

As best shown in FIG. 12C, the quick-tightening feature 105 may be used to tighten a majority of the strap 35 prior to gathering the strap 35 around the spool 20 via the bi-directional ratcheting mechanism. For example, the ends 106, 107 of the strap 35 may be pulled through the quick-tightening feature 105 thereby reducing the necessary amount of time and effort spent operating the ratcheting to secure the cargo or load. The quick-tightening feature 105 allows a large portion of the slack in the strap 35 to be cinched relatively tightly in seconds. Such a configuration reduces the time and effort ratcheting the lever 30 and also prevents too much strap 35 from being gathered onto the spool 20.

Figure 18:
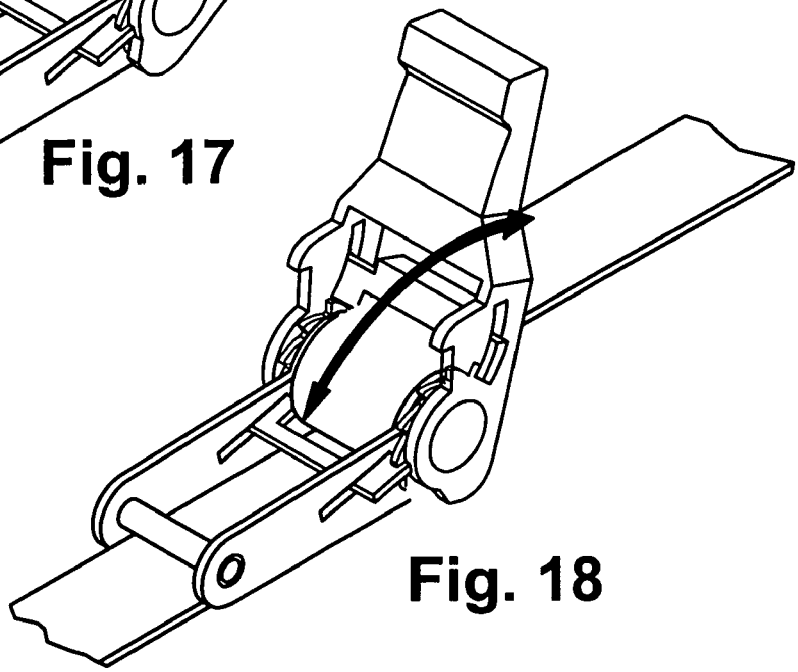
FIG. 18 illustrates a perspective view of an embodiment of a securing mechanism in use.

The final tightening may be done in the traditional fashion, using the lever 30 and handle 95. As shown in FIGS. 12D and 18, the lever 30 may be ratcheted to gather the strap 35 bi-directionally by the spool 20. Thus, the strap 35 may be gathered from both ends 106, 107 at the same time and around the spool 20. As a result, the slack in the strap 35 may be taken out (and the cargo is secured) and gathered around the spool 20 approximately twice as fast as prior ratchets.

While the present invention is described with reference to embodiments described herein, the present invention is not limited to such embodiments. Therefore, the description of the embodiments herein is merely illustrative of the embodiments of the present invention and will not limit the scope of the invention as claimed. The invention has been described above and, obviously, modifications and alternations will occur to others upon a reading and understanding of this specification. The claims as follows are intended to include all modifications and alterations insofar as they come within the scope of the claims or the equivalent thereof.

Moreover, while the present securing mechanism 10 may be described in the context of retraining a load or cargo in association with a vehicle or trailer, however, it will be appreciated that the securing mechanism 10 may be used in any variety of contexts, and, as such, any reference to restraining cargo or use with trailer and vehicles is illustrative in nature and not restrictive in any way. In addition, the description of the embodiments provided may refer to the use of specific options or materials, however, this should not limit the scope of the invention as claimed. Those skilled in the art will understand that the above descriptions should only be taken as illustrative.

Having thus described the invention, we claim:

1. A securing mechanism for securing cargo, said securing mechanism comprising:
- a body capable of receiving a strap therethrough, wherein said strap includes opposing ends;
- at least one aperture positioned on said body, said at least one aperture capable of attaching additional devices to said body;
- a ratchet comprising:
  - a pair of opposing arms connected to said body;
  - a spool rotatably connected to said opposing arms, said spool including a slot to receive said strap;
  - a pair of ratchet wheels connected to opposing ends of said spool; and
  - wherein said spool gathers said strap into a z-fold configuration via said slot;
- a lever rotatably attached to said arms and reciprocated between a first position and a second position, wherein said lever includes at least one pawl to engage said ratchet wheels and rotates said spool when said lever is reciprocated;
- a release mechanism capable of selectively disengaging said pawl from said ratchet wheel; and
- wherein said body is selectively positionable along said strap via said slot until said strap is bi-directionally gathered onto said spool.

2. The securing mechanism of claim 1, wherein said body includes a guide capable of guiding said strap onto said spool.

3. The securing mechanism of claim 1, wherein said body further includes a cap located on each end of said spool for securing said spool within said mechanism.

4. The securing mechanism of claim 1, wherein said body has a soft bottom capable of protecting the cargo.

5. The securing mechanism of claim 1, further including a securing member having a quick tightening feature capable of removing slack from said strap.

6. The securing mechanism of claim 5, wherein said quick tightening feature is a buckle.

7. The securing mechanism of claim 1, wherein said body is selectively positionable along a length of said strap via said slot while said lever is in said second position.

8. A securing mechanism comprising:
- a body capable of receiving a strap, said body having a periphery;
- at least one attachment mechanism positioned on said periphery of said body, said at least one attachment mechanism capable of attaching additional devices to said body; and
- a ratchet assembly operatively coupled to said body, wherein said ratchet assembly is operatively positionable when at least one additional device is attached to said body.

9. The securing mechanism of claim 8, wherein said at least one attachment mechanism comprises at least one aperture, wherein said at least one aperture is capable of attaching additional devices to said body.

10. The securing mechanism of claim 8, further comprising a strap guide attached to said body, said strap guide capable of facilitating feeding and guiding said strap into said ratchet assembly.

11. The securing mechanism of claim 8, further comprising a lever operatively coupled to said ratchet assembly and positionable between a first position and a second position wherein said lever includes a first handle and said first handle includes at least one handle attachment mechanism capable of attaching additional devices to said first handle.

12. The securing mechanism of claim 11, further comprising a second handle attached to said body, wherein said second handle includes at least one second handle attachment mechanism capable of attaching additional devices to said second handle.

13. The securing mechanism of claim 12, wherein said second handle includes a strap guide, wherein said strap guide is capable of facilitating feeding and guiding said strap into said ratchet assembly.

14. A securing mechanism comprising:

a body capable of receiving a strap, said strap capable of traveling within said body along a path;

at least one aperture positioned on said body and positioned free of said path of said strap, said at least one aperture capable of attaching additional devices to said body;

a ratchet assembly operatively coupled to said body; and a lever operatively coupled to said ratchet assembly and positionable between a first position and a second position, wherein said lever is positionable between said first and second positions when at least one additional device is attached to said body.

15. The securing mechanism of claim 14, wherein said ratchet assembly includes a spool wherein said spool gathers said strap into a substantially z-fold configuration.

16. The securing mechanism of claim 15, wherein said spool includes a slot and wherein said slot allows said body to be selectively positionable along said strap.

17. The securing mechanism of claim 14, wherein said strap is capable of being tethered in at least two directions relative to said body.

18. The securing mechanism of claim 14, wherein said lever includes at least one aperture for attaching additional devices to said lever.

19. The securing mechanism of claim 14, wherein said lever includes a handle and said handle includes at least one aperture for attaching additional devices to said handle.

20. The securing mechanism of claim 14, further comprising a strap guide facilitating feeding and guiding of said strap into said ratchet mechanism.

21. A securing mechanism comprising:

a body capable of receiving a strap;

at least one aperture positioned on said body, said at least one aperture capable of attaching additional devices to said body;

a ratchet assembly operatively coupled to said body; and a lever operatively coupled to said ratchet assembly and positionable between a first position and a second position, wherein said lever includes at least one aperture for attaching additional devices to said lever.

22. A securing mechanism comprising:

a body capable of receiving a strap;

at least one aperture positioned on said body, said at least one aperture capable of attaching additional devices to said body;

a ratchet assembly operatively coupled to said body; and a lever operatively coupled to said ratchet assembly and positionable between a first position and a second position, wherein said lever includes a handle and said handle includes at least one aperture for attaching additional devices to said handle.

23. A securing mechanism comprising:

a body capable of receiving a strap;

a ratchet assembly operatively coupled to said body; and a lever operatively coupled to said ratchet assembly and positionable between first and second positions; and a handle attached to said lever, wherein said handle includes at least one gripping aperture and at least one attachment mechanism capable of attaching additional devices to said handle.

24. The securing mechanism of claim 23, wherein said at least one attachment mechanism includes at least one aperture positioned on said handle.

* * * * *